US005266909A

United States Patent [19]

Wolfert

[11] Patent Number: 5,266,909

[45] Date of Patent: Nov. 30, 1993

[54] WAVEGUIDE CIRCULATOR

[75] Inventor: Paul H. Wolfert, Portola Valley, Calif.

[73] Assignee: Harris Corporation, Melbourne, Fla.

[21] Appl. No.: 925,028

[22] Filed: Aug. 5, 1992

[51] Int. Cl.[5] ..... H01P 1/39

[52] U.S. Cl. ..... 333/1.1; 333/249; 333/33

[58] Field of Search ..... 333/1.1

[56] References Cited

U.S. PATENT DOCUMENTS

| | | | |
|---|---|---|---|
| 2,951,216 | 8/1960 | Nelson et al. . | |
| 3,466,571 | 9/1969 | Jansen et al. | 333/1.1 |
| 3,555,459 | 1/1971 | Anderson | 333/1.1 |
| 3,866,150 | 2/1975 | Thai et al. | 333/1.1 |
| 4,034,377 | 7/1977 | Knox et al. | 333/1.1 X |
| 4,209,756 | 6/1980 | Jin et al. | 333/1.1 |
| 4,222,015 | 9/1980 | Hauth et al. | 333/1.1 |
| 4,280,111 | 7/1981 | Forterre et al. | 333/1.1 |
| 4,460,879 | 7/1984 | Hirose | 333/1.1 X |
| 4,471,329 | 9/1984 | Cavalieri d'Oro | 333/1.1 |
| 4,496,915 | 1/1985 | Mathew et al. | 333/1.1 |
| 4,604,590 | 8/1986 | Mlinar et al. | 333/1.1 |

FOREIGN PATENT DOCUMENTS 2021484 11/1971 Fed. Rep. of Germany ..... 333/1.1

OTHER PUBLICATIONS

Southworth, Principles & Applications of Waveguide Transmission, Van Nostrand Co., N.Y., 1950 p. 246.

*Primary Examiner*—Paul Gensler

*Attorney, Agent, or Firm*—Barnes & Thornburg

[57] ABSTRACT

A circulator including a unique shaped transformer having triangular apexes extending symmetrically into the respective channel and connected to two opposed side walls by coplanar tabs. One of the channel sidewalls has a minimum of three sections to provide a transition between a first linear section extending from the center junction, and a second linear section extending from the port. The opposed sidewall has only two linear sections. The coplanar tabs are connected to the triangular apexes by a portion curved in the coplanar plane. One of the channels includes two opposed linear walls extending between the center and the port with a pair of opposed studs extending from each wall toward each other. These studs are coplanar with the tabs and used for tuning. The studs also have a portion curved in the coplanar plane.

13 Claims, 3 Drawing Sheets

WAVEGUIDE CIRCULATOR

BACKGROUND AND SUMMARY OF INVENTION

The present invention relates generally to waveguide circulators and more specifically to wideband junction circulators.

Circulators are microwave components with three or more ports which transmit microwave energy from a first port to a second port while leaving a third port and other additional ports isolated from the flow of energy. The typical waveguide junction circulator is a metallic structure which contains three coplanar waveguides intersecting at the center of the structure forming a waveguide junction. A ferrite rod or triangular prism is mounted at the center of the junction and is subject to a transverse DC magnetic field generated by two permanent magnets. Interaction of microwave energy with the ferrite causes circulation, that is, energy entering the function from one port is directed to the adjoining port in the clockwise direction (counterclock for reverse magnetic bias field).

Many circulator junctions can be combined in one housing to generate multi-junction circulators. The single junction circulator is generally referred to as a three port. A three port with straight waveguide sections is said to have a Y shape. The most common shape is the T shape which has two in-line terminals and a terminal spaced 90 degrees to the in-line direction. The in-line terminals require 30 degree waveguide bends between terminals and junction.

Circulators include waveguide transformers at the junction and extending into each of the channels toward the ports on the top and bottom walls. The impedance transformers match the impedance of the waveguide to the impedance of the ferrite.

The performance of a circulator is measured in terms of insertion loss, return loss, port isolation and operating band width. Performance is considered good when the device has a low insertion loss, high return loss and high isolation over a broad band of frequencies. Broad bandwidth typically assures good temperature stability.

In an effort to increase the isolation or reduce insertion losses, it has been suggested in U.S. Pat. No. 3,555,459 to Anderson to reduce abrupt changes in the walls of the channel between the junction and the port such that $d\theta/dy$ is less than $d\theta'/dy'$. Although mathematically accurate, these devices are difficult to manufacture. Impedance matching may also be achieved by a paralleling impedance matching steps in each of the channels as illustrated in U.S. Pat. No. 4,496,915 to Mathew, et al. This is also a difficult device to manufacture.

With an ideal circulator, the response functions of port return loss for different ports are identical, so are insertion loss and isolation for different port combinations. Actual circulators have electrical asymmetries caused by mechanical asymmetries due to the tolerances of the components and the assembly.

Most present art designs require tuning after assembly to achieve the required performance. Typically, dielectric or metallic blocks are cemented into the waveguide sections of the circulator. The tuning is required to correct design deficiencies (systematic errors) and compensate for mechanical asymmetry such as chipped corners or misalignment of the ferrite (random errors). Such tuning is "cut and try", and is therefore, time consuming and too costly a process for mass production.

Thus, it is an object of the present invention to provide a circulator which eliminates tuning to correct systematic errors.

Another object of the present invention is to provide a circulator having design characteristics which are easily and accurately manufacturable.

A further object of the present invention is to provide a circulator of a construction which assures minimum asymmetry.

A still further object of the present invention is to provide a circulator construction which minimizes random errors.

These and other objects are achieved by using a unique shaped transformer having triangular apexes extending symmetrically into the respective channel and connected to two opposed side walls by coplanar tabs. An additional important feature is that one of the channel sidewalls has a minimum of three sections to provide a transition between a first linear section extending from the center junction, and a second linear section extending from the port. The opposed sidewall has only two linear sections. The coplanar tabs are connected to the triangular apexes by a portion curved in the coplanar plane. Where the circulator has three ports and three channels, there are three tabs. The triangular apexes have common linear sides with adjacent triangular apexes and the tabs connect the common side to the opposed sidewalls of the channels.

One of the channels includes two opposed linear walls extending between the center and the port with a pair of opposed studs extending from each wall toward each other. These studs are coplanar with the tabs and are used for tuning. The studs also have a portion curved in the coplanar plane.

Other objects, advantages and novel features of the present invention will become apparent from the following detailed description of the invention when considered in conjunction with the accompanying drawings.

BEST MODES FOR CARRYING OUT THE INVENTIONS

Figure 1:
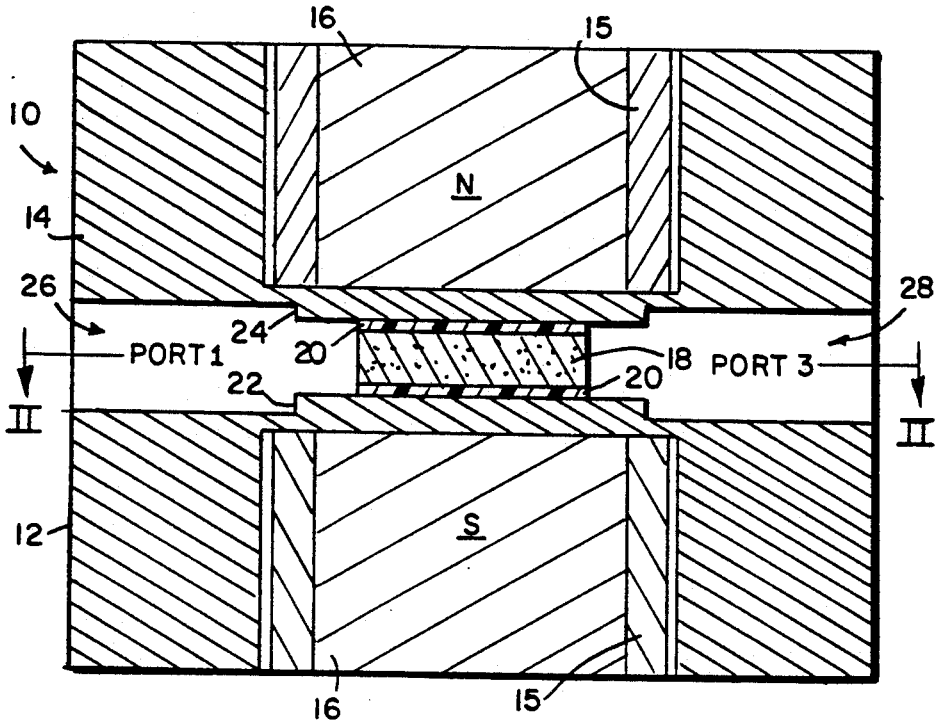
PRIOR ART FIG. 1
FIG. 1 is a cross-sectional view of a circulator of the prior art.
Figure 2:
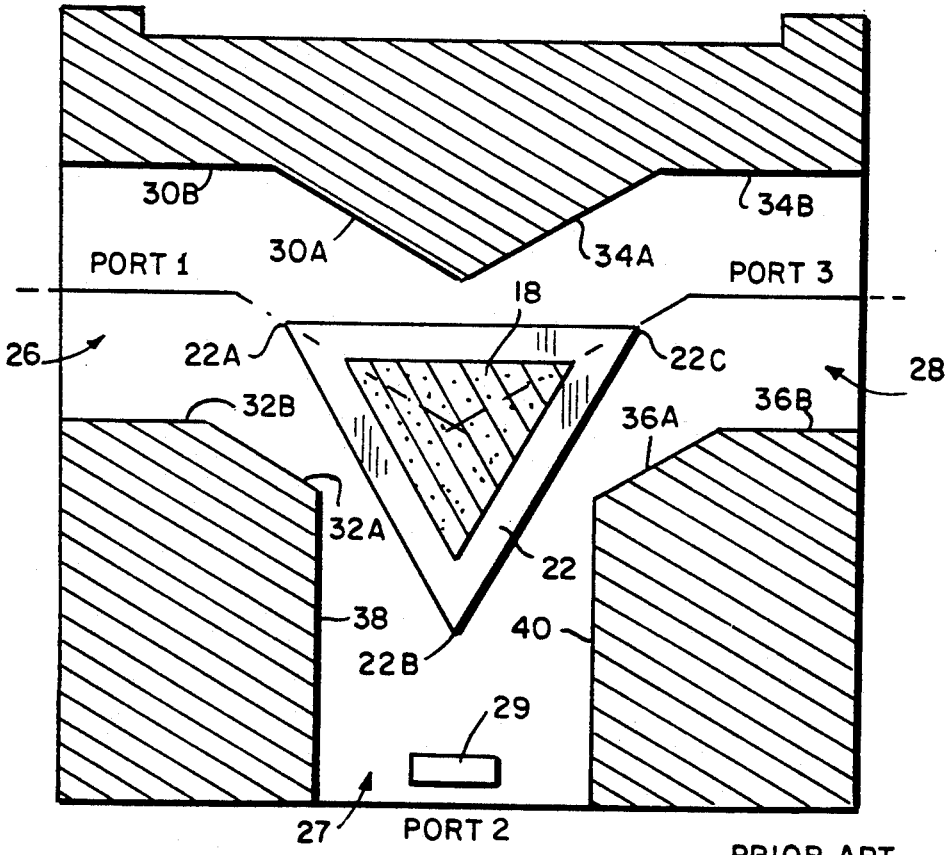
PRIOR ART FIG. 2
FIG. 2 is a cross-sectional view taken along lines II—II of FIG. 1.

A circulator 10 of the prior art is illustrated in FIGS. 1 and 2 as including a bottom housing section 12 and a top housing section 14 held together by fasteners (not shown). Each housing includes at their center oppositely poled magnets 16. A carpenter steel ring 15 is provided for temperature stabilization of the D.C. field. Ferrite triangular prism 18 is provided at the center of circulator 10 and is separated from the housing section 12, 14 by dielectric spacers 20. The spacers are Teflon, Rexolite or other suitable materials.

The bottom housing section 12 includes a transformer 22 and the top housing section 14 includes a transformer 24 extending along opposite walls of the channels at the center. Ports 1, 2 and 3 are connected to the center by channels 26, 27 and 28 respectively. The ferrite prism 18 and the transformers 22 and 24 have ends extending into the channels 26, 27 and 28. As illustrated in FIG. 2, the triangular apex 22A extends into channel 26, triangular apex 22B extends into channel 27, and triangular apex 22C extends into channel 28. The ferrite prism 18 and the transformers 22 and 24 are designed to be symmetrical with respect to their respective channels.

The channels in the housing sections 12, 14 form a coplanar H-plane waveguide junction disposed about a central vertical axis at an angular spacing of 120 degrees. The waveguide cross-sectional dimensions are typically of the standard S12E for the required frequency band. A triangular pedestal 22 and 24 centered at the axis of the waveguide channels serves as an impedance transformer to match the ferrite impedance to the waveguide impedance.

The opposed walls 30 and 32 of channel 26 include two linear sections 30A, 30B and 32A, 32B respectively. Channel 28 also includes two opposed walls 34 and 36 each composed of two linear sections 34A, 34B and 36A, 36B respectively. The angle between linear sections of channels 26 and 28 is 30 degrees to accommodate the in-line portion of ports 1 and 3. Channel 27 includes two opposed walls 38 and 40 each of a single linear section. Electromagnetic energy appearing at port 1 circulates to port 2 and from port 2 to port 3.

A tuning block 29 as illustrated in channel 27 of port 2 is typically required. Other tuning elements such as dielectric and metal blocks are cemented to the tips of the transformer triangles and may be cemented at other locations to tune the circulator and to establish port symmetry. Typically such tuning is by "cut and try" and becomes difficult if the ferrite prism 18 has asymmetry or is not precisely located at the junction center.

Figure 3:
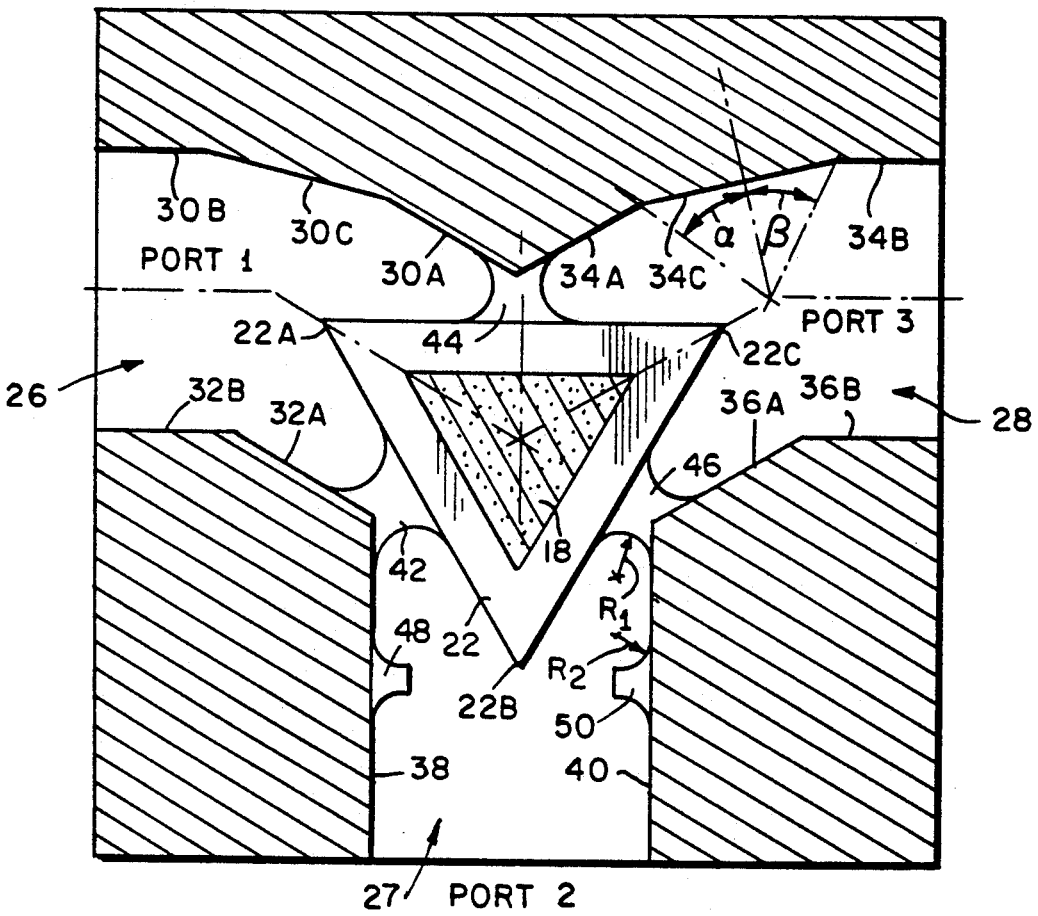
FIG. 3 is a cross-sectional view similar to FIG. 2 of a circulator incorporating the principles of the present invention.

A circulator, as illustrated in FIG. 3, includes the transformer 22 extending into the channels 26, 27 and 28 of ports 1, 2 and 3. The first modification, as compared to the prior art, is that the walls 30 and 34 of channels 26 and 28 include a three linear sections 30A, 30B, 30C and 34A, 34B, 34C respectively. Section 30A and 30B of channel 26 extend at a first end from the center and the port 1 of the circulator respectfully and are joined at their second ends by a linear or transitional section 30C. The opposing wall 32 of channel 26 has only two linear sections 32A and 32B having their first end at center and the port 1 respectively and joined at their second ends. The same is true for channel 28, wherein wall 34 has three linear sections 34A, 34B and 34C and the opposed wall 36 has two linear sections 36A and 36B. The channel 27 for port 2 has two linear opposed walls 38 and 40.

The length and symmetry of the transition sections 30C or 34C are measured by the angles $\alpha$ and $\beta$ with respect to the intersection of the axis of the two general linear portions of the channel regions 26, 28. Generally, $\alpha$ is equal to $\beta$ and therefore the length of the transition section is symmetrical with respect to the bend of the channel. The size of the transition sections 30C and 34C increases the band width of port 1 and improves the return loss of port 3. For example, the angles $\alpha$ and $\beta$ are in the range of 20 deg. to 50 deg.

Each of the transformers 22 and 24 is connected to a respective sidewall of the channel by coplanar tabs. As illustrated in FIG. 3, the transformer 22 includes a tab 42 connecting the common wall between apexes 22A and 22B to the sidewalls 32 and 38 of channels 26 and 27. The common wall of apexes 22A and 22C are connected to the sidewalls 30 and 34 of channels 26 and 28 by tab 44. The common wall of apexes 22B and 22C are connected to the sidewalls 40 and 36 of channels 27 and 28 by tab 46. The tabs also increase the band width and improve the return loss. It has also been found that providing sections of the tabs curved in the coplanar plane of the transformer and having a radius of R1 for the tabs 42, 44 and 46 improves the operating results. The radius of curvature R1 may be in the range of 1/6 to 1/20 of the waveguide channel width.

Tuning of port 2, in lieu of the tuning block 29 of FIG. 1, may be achieved by providing studs 48 and 50 extending from the opposing walls 38 and 40 along the top and bottom walls and coplanar with the transformers 22 and 24 and its connecting tabs 42, 44 and 46. As with the connecting tabs, the studs have a radius of curvature R2 in the coplanar plane. The radius of curvature and the length of extension of the opposing studs can be used to control the tuning. Typically the studs 48 and 50 extend in a range of 1/6 to 1/10 of the waveguide channel width.

The transformers 22 and 24, the opposed walls segments 30, 32, 34, 36, 38 and 40, the connecting tabs 42, 44, 46 and the tuning studs 48 and 50 are all machined into the respective housing sections 12 and 14 of the circulator 10. With appropriate computer control machines, variations of the radius of curvatures R1 and R2, the size of the transformers 22 and 24, the angles and lengths of the walls segments 32, 34, 36 are all easily modified to obtain the appropriate center frequency, band width, insertion loss, return loss and isolation.

Precision manufacture of the ferrite prism and center alignment of the ferrite at assembly of the circulator have minimized all random errors, establishing a very good degree of mechanical and associated electrical symmetry of performance. This invention allows quick assembly and allows a quick assessment of quality of the ferrite assembly on a "go—no go" basis.

Figure 4:
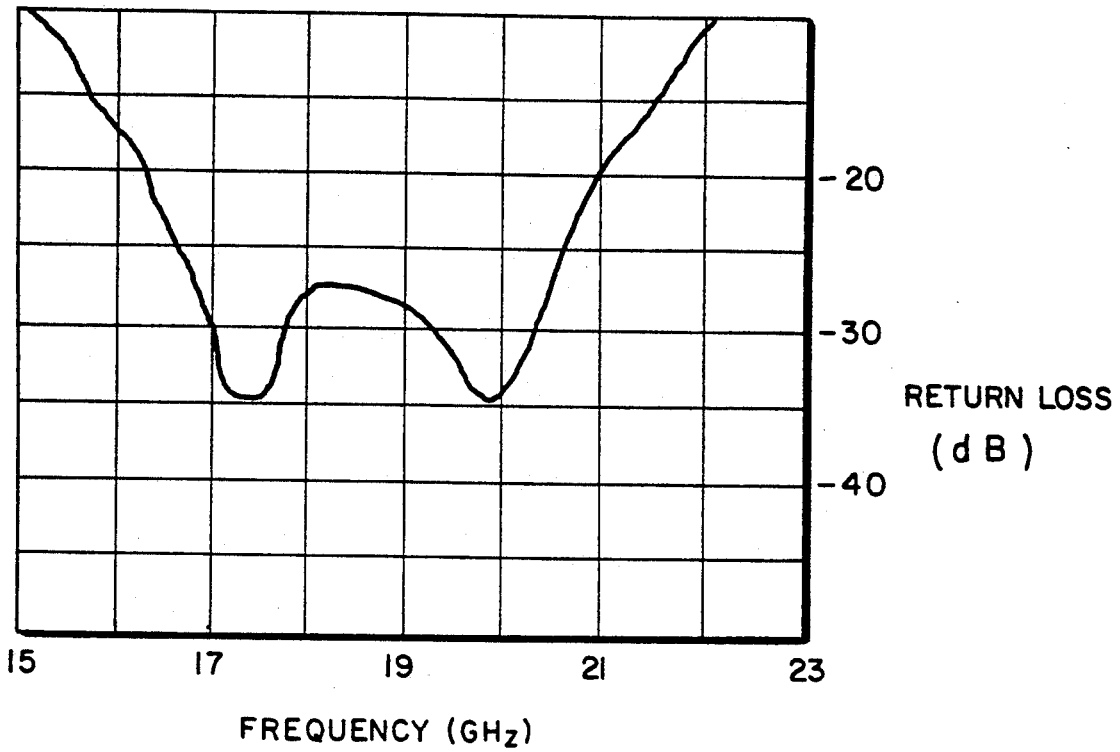
FIG. 4 is a graph of return loss versus frequency of a circulator incorporating the principles of the present invention.
Figure 5:
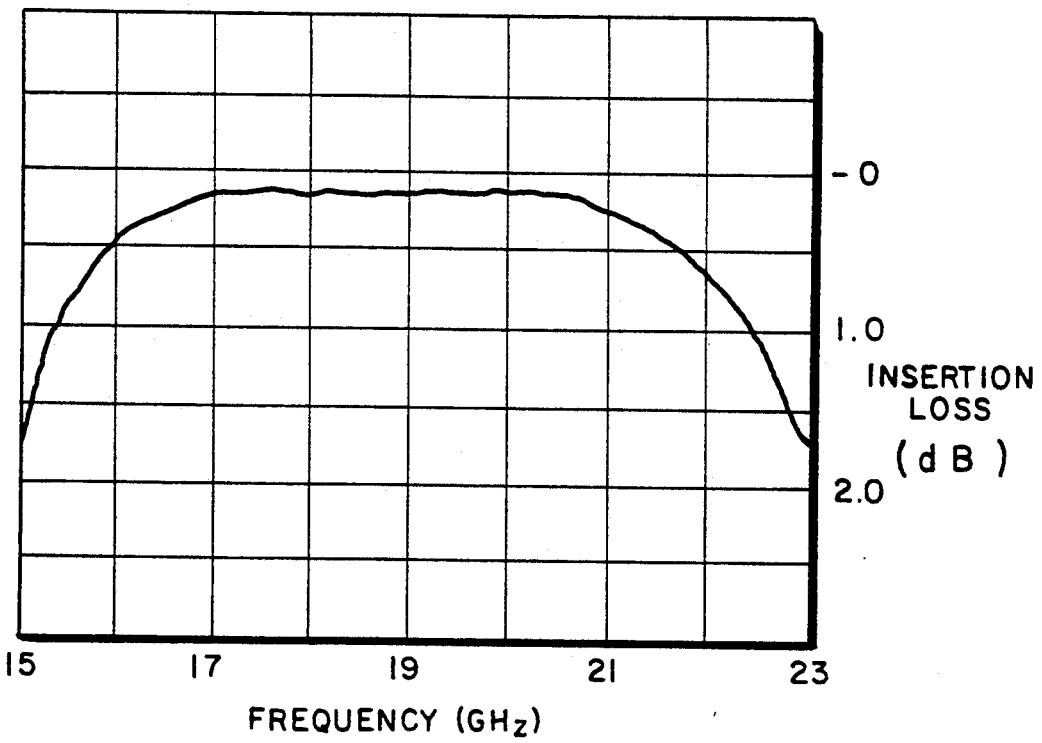
FIG. 5 is a graph of insertion loss versus frequency of a circulator incorporating the principles of the present invention.

Test results showed the circulator having a band width in the range of 20% to 30%, a return loss in the range of 20 dB to 30 dB and insertion loss in the range of 0.15 dB to 0.30 dB. FIGS. 4 and 5 show return loss and insertion loss respectively for one prototype having these valves in the 17 to 21 Ghz frequency range.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A circulator adapted to be biased by a dc magnetic field comprising:

a conductive body having a at least three ports connected to a center of said body by a corresponding waveguide channel;

ferrite material at said center intersection of said channels; and first impedance transformer means having a plurality of coplanar triangular apexes extending symmetrically into a respective channel along a first wall and spaced from opposed second and third walls of a respective channel and having a plurality of coplanar tabs each connecting a side of a respective triangular apex to a respective second and third wall.

2. A circulator according to claim 1 including second impedance transformer means having a plurality of coplanar triangular apexes extending symmetrically into a respective channel along a fourth wall opposed said first wall and spaced from said opposed second and third walls of a respective channel and having a plurality of coplanar tabs each connecting a side of a respective triangular apex to a respective second and third wall.

3. A circulator according to claim 1 wherein said tabs include a portion curved in said coplanar plane.

4. A circulator according to claim 1 including three ports, three channels, three triangular apexes and three tabs.

5. A circulator according to claim 1 wherein said triangular apexes each have a linear side common with adjacent triangular apex and said tabs connect said common sides to said second and third walls.

6. A circulator according to claim 1 wherein at least one of said channels includes:

first and second linear sections of said second wall extending at one end from said center of said body and a port respectively and intersecting at their second ends; and first and second linear sections of said third wall extending at one end from said center of said body and a port respectively and joined at their second ends by a third transition section.

7. A circulator according to claim 6 wherein said third transition section is linear.

8. A circulator according to claim 1 wherein at least one of said channels includes:

linear second and third opposed walls extending from said center of said body to a respective port; and a pair of opposed studs extending from a respective second and third wall of said at least one third channel toward each other along said first wall and coplanar with said transformer means.

9. A circulator according to claim 8 wherein said studs include a portion curved in said coplanar plane.

10. A circulator adapted to be biased by a dc magnetic field comprising:

a conductive body having at least three ports connected to a center of said body by a corresponding waveguide channel having first and second opposed walls;

ferrite material at said center intersection of said channels; and at least one of said channels including first and second linear sections of said first wall extending at one end from said center of said body and a port respectively and intersecting at their second ends, and first and second linear sections of said second wall extending at one end from said center of said body and said port respectively and joined at their second ends by a third linear transition section.

11. A circulator according to claim 10 including three ports and three channels;

two of said channels including first and second linear sections of said first wall extending at one end from said center of said body and a port respectively and intersecting at their second ends, and first and second linear sections of said second wall extending at one end from said center of said body and a port respectively and joined at their second ends by a third transition section; and a third channel including linear first and second walls extending from said center of said body to a respective port.

12. A circulator according to claim 10 including:

a second channel having linear first and second walls extending from said center of said body to a respective port; and two pairs of opposed studs extending from a respective first and second wall of said second channel toward each other along opposed third and fourth walls respectively of said second channel.

13. A circulator according to claim 12 wherein said studs include a portion curved in the plane of said third and fourth walls.

* * * * *